US010108109B2

(12) United States Patent
Ishii et al.

(10) Patent No.: US 10,108,109 B2
(45) Date of Patent: Oct. 23, 2018

(54) DEVELOPING DEVICE AND IMAGE FORMING APPARATUS

(71) Applicant: FUJI XEROX CO., LTD., Tokyo (JP)

(72) Inventors: Yasutomo Ishii, Kanagawa (JP); Shunichiro Shishikura, Kanagawa (JP); Toshiaki Suzuki, Kanagawa (JP); Hiroaki Okuma, Kanagawa (JP); Daisuke Uchimitsu, Kanagawa (JP); Ryo Fukuno, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/683,200

(22) Filed: Aug. 22, 2017

(65) Prior Publication Data

US 2018/0107136 A1 Apr. 19, 2018

(30) Foreign Application Priority Data

Oct. 18, 2016 (JP) ..... 2016-204586

(51) Int. Cl.
*G03G 15/08* (2006.01)
*G03G 15/09* (2006.01)

(52) U.S. Cl.
CPC ..... *G03G 15/0889* (2013.01); *G03G 15/0844* (2013.01); *G03G 15/0921* (2013.01)

(58) Field of Classification Search
CPC ..... G03G 15/0822; G03G 15/0844; G03G 15/0889; G03G 15/09; G03G 15/0921
USPC ..... 399/257
See application file for complete search history.

(56) References Cited

U.S. PATENT DOCUMENTS

| | | | | |
|---|---|---|---|---|
| 4,891,673 | A | 1/1990 | Buell | |
| 5,095,338 | A * | 3/1992 | Hayes, Jr. | G03G 15/0844 399/257 |
| 8,027,623 | B2 | 9/2011 | Nodera et al. | |
| 9,429,875 | B1 * | 8/2016 | Suenami | G03G 15/0844 |
| 2009/0067878 | A1 * | 3/2009 | Tateyama | G03G 15/0893 399/257 |
| 2016/0091816 | A1 * | 3/2016 | Kochi | G03G 15/0131 399/66 |

FOREIGN PATENT DOCUMENTS

| | | | |
|---|---|---|---|
| JP | 02-74973 | A | 3/1990 |
| JP | 2009-69225 | A | 4/2009 |

* cited by examiner

*Primary Examiner* — Sophia S Chen
(74) *Attorney, Agent, or Firm* — Sughrue Mion, PLLC

(57) ABSTRACT

A developing device includes a container that contains a developer including a carrier and a toner; a transport member that is rotatably disposed in the container and that agitates and transports the developer in a rotation-axis direction thereof; a discharge outlet that has an opening in a side wall of the container facing in a direction perpendicular to the rotation-axis direction, the discharge outlet allowing the developer to be discharged to an outside of the container when a height of a surface of the developer becomes greater than a height of a lower surface of the discharge outlet; and a magnetic member that is disposed at a position that is above the lower surface of the discharge outlet and that overlaps the lower surface in an up-down direction, the magnetic member attracting a part of the developer that is lifted up by the transport member.

10 Claims, 8 Drawing Sheets

DEVELOPING DEVICE AND IMAGE FORMING APPARATUS

CROSS-REFERENCE TO RELATED APPLICATIONS

This application is based on and claims priority under 35 USC 119 from Japanese Patent Application No. 2016-204586 filed Oct. 18, 2016.

BACKGROUND

(i) Technical Field

The present invention relates to a developing device and an image forming apparatus.

(ii) Related Art

Some existing developing devices have a developer-discharge structure that discharges a developer to the outside through a discharge outlet, which is formed in a side wall of a container, when the height of the surface of the developer in the container becomes greater than the height of the discharge outlet. With the developing devices having such an output structure, as an auger rotates in the container, the developer in the container may be lifted up and scattered and may be discharged through the discharge outlet. If the developer is discharged through the discharge outlet before the height of the surface of the developer becomes greater than the height of the discharge outlet, the amount of developer in the container may become insufficient.

SUMMARY

According to an aspect of the invention, a developing device includes a container that contains a developer including a carrier and a toner; a transport member that is rotatably disposed in the container and that agitates and transports the developer in a rotation-axis direction thereof; a discharge outlet that has an opening in a side wall of the container facing in a direction perpendicular to the rotation-axis direction, the discharge outlet allowing the developer to be discharged to an outside of the container when a height of a surface of the developer becomes greater than a height of a lower surface of the discharge outlet; and a magnetic member that is disposed at a position that is above the lower surface of the discharge outlet and that overlaps the lower surface in an up-down direction, the magnetic member attracting a part of the developer that is lifted up by the transport member.

BRIEF DESCRIPTION OF THE DRAWINGS

An exemplary embodiment of the present invention will be described in detail based on the following figures, wherein.

DETAILED DESCRIPTION

Referring to FIGS. 1 to 10, an image forming apparatus according to an exemplary embodiment of the present invention will be described. In each of the figures, an arrow H indicates the apparatus-height direction (apparatus-up-down direction) and an arrow W indicates the apparatus-width direction.

Overall Structure of Image Forming Apparatus

Figure 1:
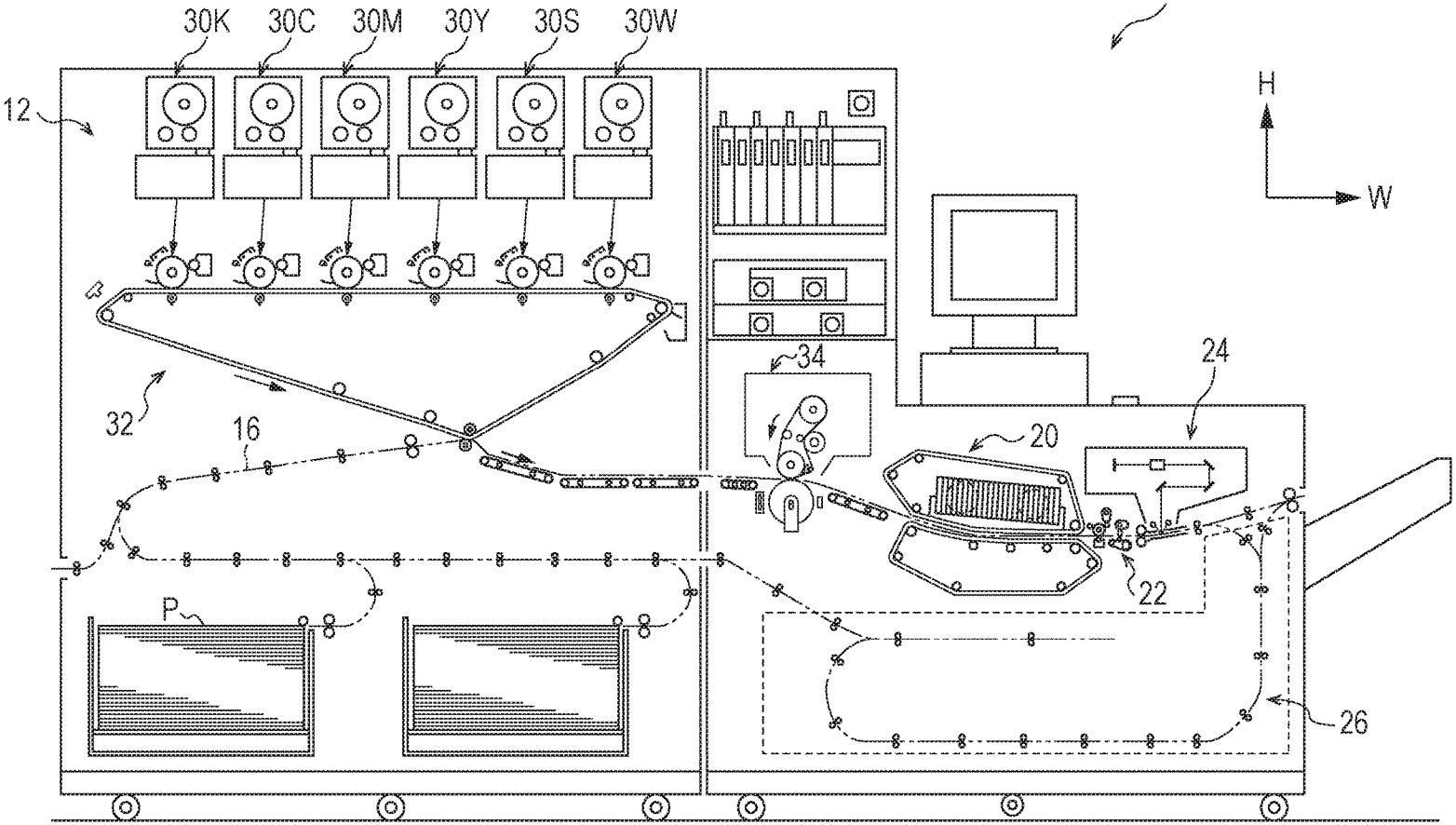
FIG. 1 illustrates the structure of an image forming apparatus according to an exemplary embodiment of the present invention.

Referring to FIG. 1, an image forming apparatus 10 includes an image forming section 12 that forms an image by using an electrophotographic method, and plural transport members (without reference numerals) that transport a sheet P (an example of a recording medium) along a transport path 16 of the sheet P.

The image forming apparatus 10 further includes a cooling unit 20 that cools the sheet P on which an image has been formed, a decurling unit 22 that removes curl of the sheet P, and an image inspection unit 24 that inspects the image formed on the sheet P.

The image forming apparatus 10 further includes a reverse path 26 that reverses a sheet P on the front surface which an image has been formed and transports the sheet P back to the image forming section 12 so as to form an image on the back surface of the sheet P.

In the image forming apparatus 10 having the structure described above, the image forming section 12 forms an image (toner image), and the image is transferred to the front surface of a sheet P that is transported along the transport path 16. The sheet P, on which the image has been formed, passes through the cooling unit 20, the decurling unit 22, and the image inspection unit 24 in this order and is discharged to the outside of the apparatus.

When forming an image on the back surface of a sheet P after forming an image on the front surface, the sheet P is transported along the reverse path 26, and the image forming section 12 forms an image again on the back surface of the sheet P.

Figure 2:
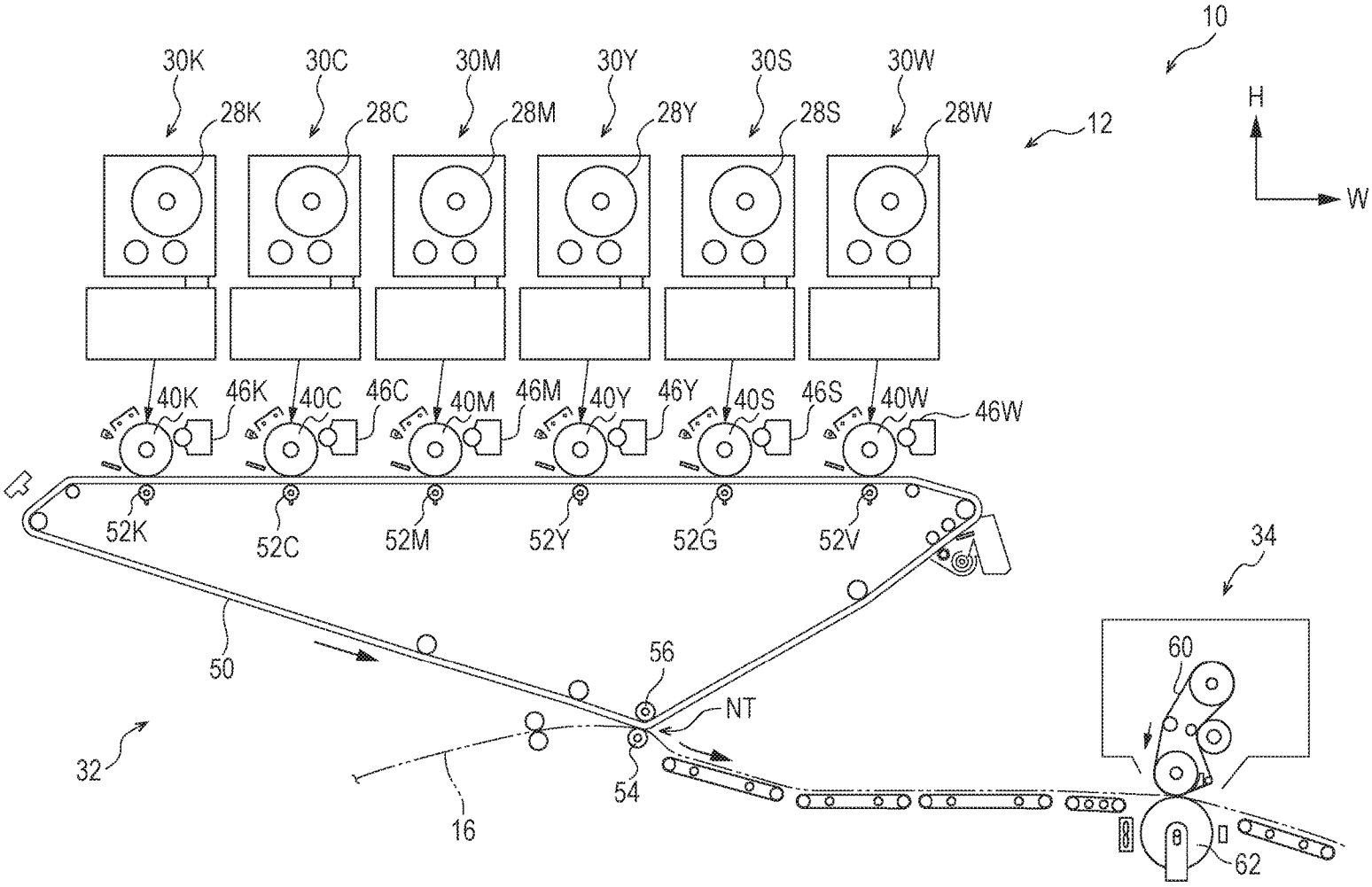
FIG. 2 illustrates the structure of an image forming section of the image forming apparatus according to the exemplary embodiment of the present invention.

Referring to FIG. 2, the image forming section 12 includes plural toner image forming units 30 that form toner images in different colors, and a transfer unit 32 that transfers the toner images formed by the toner image forming units 30 to the sheet P. The image forming section 12 further includes a fixing unit 34 that fixes the toner images, which have been transferred to the sheet P by the transfer unit 32, to the sheet P.

The toner image forming units 30 form toner images in different colors. In the present exemplary embodiment, the toner image forming units 30 form toner images in six colors, which are white (W), silver (S), yellow (Y), magenta (M), cyan (C), and black (K). The characters W, S, Y, M, C, and K in FIG. 2 denote the above colors.

Yellow (Y), magenta (M), cyan (C), and black (K) are four reference colors for forming a color image. White (W) and silver (S), which are not reference colors, are used to expand the gamut of an output image (hereinafter, referred to as "special colors").

In the present exemplary embodiment, the particle sizes of developers G in yellow (Y), magenta (M), cyan (C), and black (K) are substantially the same. The particle sizes of developers G in white (W) and silver (S) differ from those of the developers G in the reference colors.

In the following description, unless it is necessary to discriminate between white (W), silver (S), yellow (Y), magenta (M), cyan (C), and black (K), the characters W, S, Y, M, C, and K will not be attached to the reference numerals.

Figure 3:
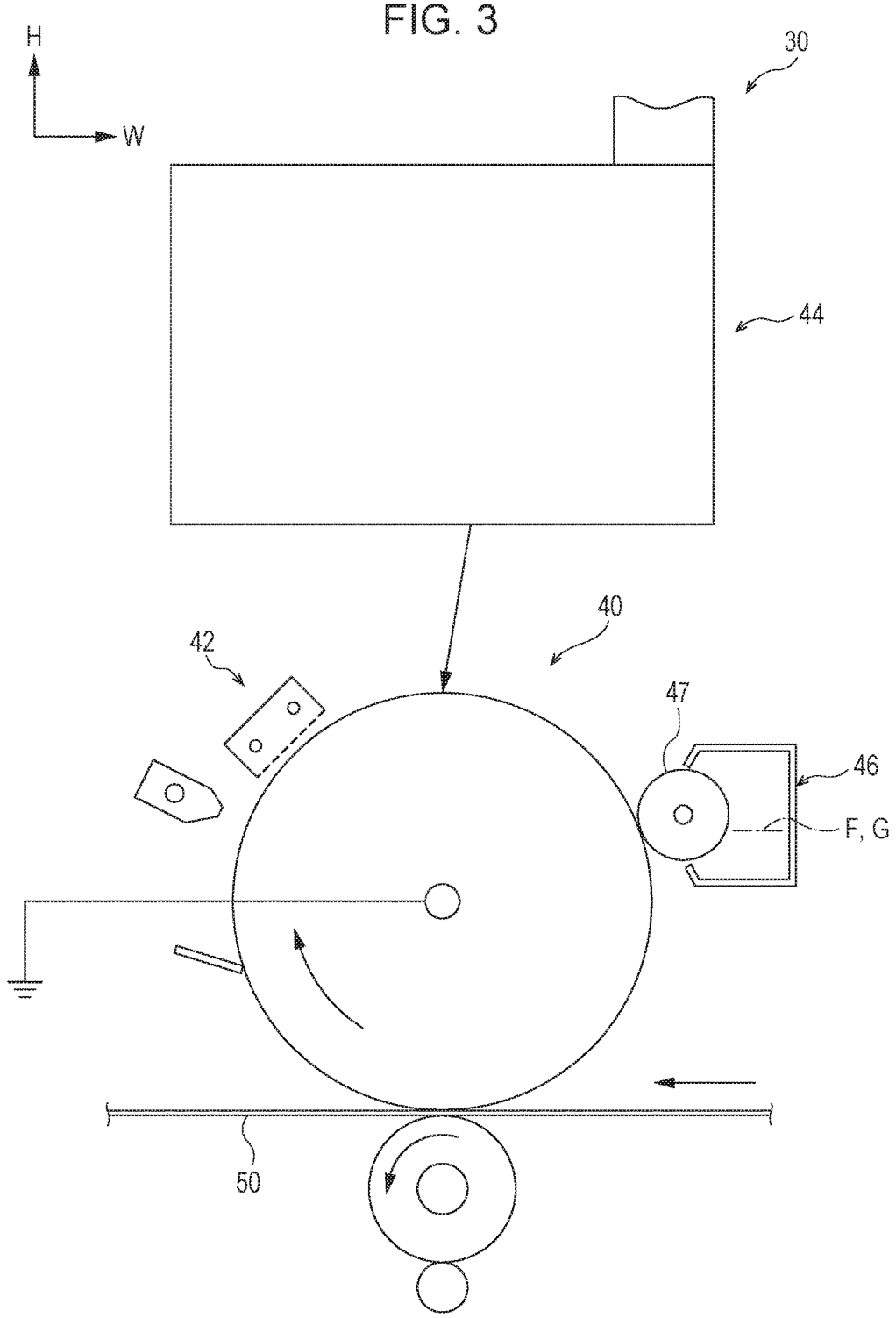
FIG. 3 illustrates the structure of a toner image forming unit of the image forming apparatus according to the exemplary embodiment of the present invention.

The toner image forming units 30 basically have the same structure except that different toners are used. Referring to FIG. 3, each of the toner image forming units 30 includes a cylindrical image carrier 40 that rotates and a charger 42 that charges the image carrier 40. The toner image forming unit 30 further includes an exposure device 44 that forms an electrostatic latent image by irradiating the charged image carrier 40 with exposure light, and a developing device 46 that develops the electrostatic latent image into a toner image by using a developer G that includes a carrier and a toner. The developing device 46 will be described below in detail.

Referring to FIG. 2, the toner image forming units 30 include toner cartridges 28 for different colors. The toner cartridges 28 are connected to the developing devices 46 for corresponding colors through supply tubes (not shown), and the developers G are supplied from the toner cartridges 28 to the developing device 46 for the corresponding colors.

The image carriers 40 for different colors are in contact with a transfer belt 50 (which will be described below in detail) that rotates. In the rotation direction of the transfer belt 50 (see an arrow in FIG. 2), the toner image forming units 30 for white (W), silver (S), yellow (Y), magenta (M), cyan (C), and black (K) are arranged in this order from the upstream side in the horizontal direction. The toner image forming units for different colors form images in corresponding colors by using toners for the corresponding colors.

Referring to FIG. 2, the transfer unit 32 includes the transfer belt 50, which is looped over plural rollers (without reference numerals) and rotates in the direction of the arrow in FIG. 2; and first-transfer rollers 52 (52K, 52C, 52M, 52Y, 52G, 52V), which are disposed opposite the image carrier 40 for different colors with the transfer belt 50 therebetween. The first transfer rollers 52 transfer toner images formed on the image carriers 40 to the transfer belt 50.

The transfer unit 32 further includes a roller 56 over which the transfer belt 50 is looped; and a second-transfer roller 54 that is disposed opposite the roller 56 with the transfer belt 50 therebetween. The second-transfer roller 54 transfers the toner images, which have been transferred to the transfer belt 50, to the sheet P. With this structure, a transfer nip NT, where the toner images are transferred to the sheet P, is formed between the second-transfer roller 54 and the transfer belt 50.

In the structure described above, toner images, which have been formed by the toner image forming units 30 for different colors, are first-transferred to the transfer belt 50 by the first-transfer rollers 52 while the transfer belt 50 rotates. The toner images, which have been first-transferred to the transfer belt 50, are second-transferred to the sheet P by the second-transfer roller 54.

The fixing unit 34 includes a fixing belt 60 that is looped over plural rollers (without reference numerals) and heated, and a pressing roller 62 that presses a sheet P against the fixing belt 60.

In this structure, while the fixing belt 60 rotates, the fixing belt 60 and the pressing roller 62 nip the sheet P, on which the toner images have been transferred, therebetween, and thereby the toner images are fixed to the sheet P.

Next, an image forming process performed by the image forming apparatus 10 will be described.

Referring to FIG. 1, when the image forming apparatus 10 operates, image data items for different colors, which are white (W), silver (S), yellow (Y), magenta (M), cyan (C), and black (K), are output to the exposure devices 44. The outer peripheral surfaces (surfaces) of the image carriers 40, which have been charged by the chargers 42, are irradiated with light beams that are emitted from the exposure devices 44 in accordance with the image data items, and thereby electrostatic latent images corresponding to the image data items for different colors are formed on the surfaces of the image carriers 40.

Next, the electrostatic latent images formed on the surfaces of the image carriers 40 are developed into toner images by the developing devices 46. The toner images on the surfaces of the image carriers 40 are successively transferred to the transfer belt 50 of the transfer unit 32 in an overlapping manner.

A sheet P that has been transported along the transport path 16 is transported to the transfer unit 32 in synchronism with the overlapping transfer of the toner images to the transfer belt 50. The toner images, which have been transferred in an overlapping manner onto the transfer belt 50, are transferred onto the sheet P, which has been transported to the transfer unit 32.

Next, the sheet P, to which the toner images have been transferred, is transported to the fixing unit 34. In the fixing unit 34, the toner images are heated and pressed, and thereby the toner images are fixed to the sheet P. The sheet P, to which the toner images have been fixed, is discharged to the outside from a discharge unit (not shown).

Structure of Developing Device

Next, the developing device 46 will be described in detail. Since the developing devices 46 for different colors have the same structure, one of the developing devices 46 will be described as an example.

Figure 4:
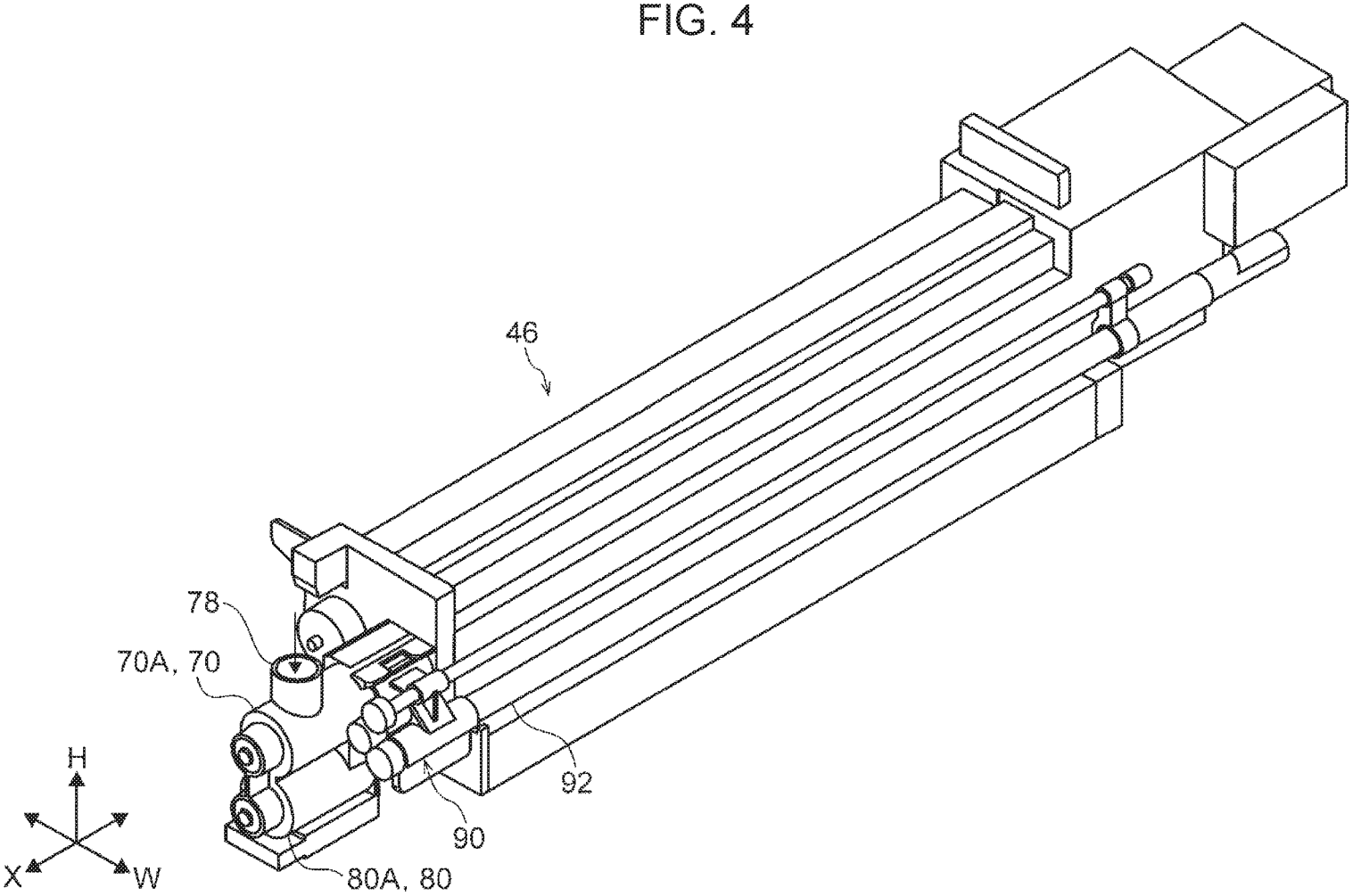
FIG. 4 is a perspective view of a developing device according to an exemplary embodiment of the present invention.
Figure 5:
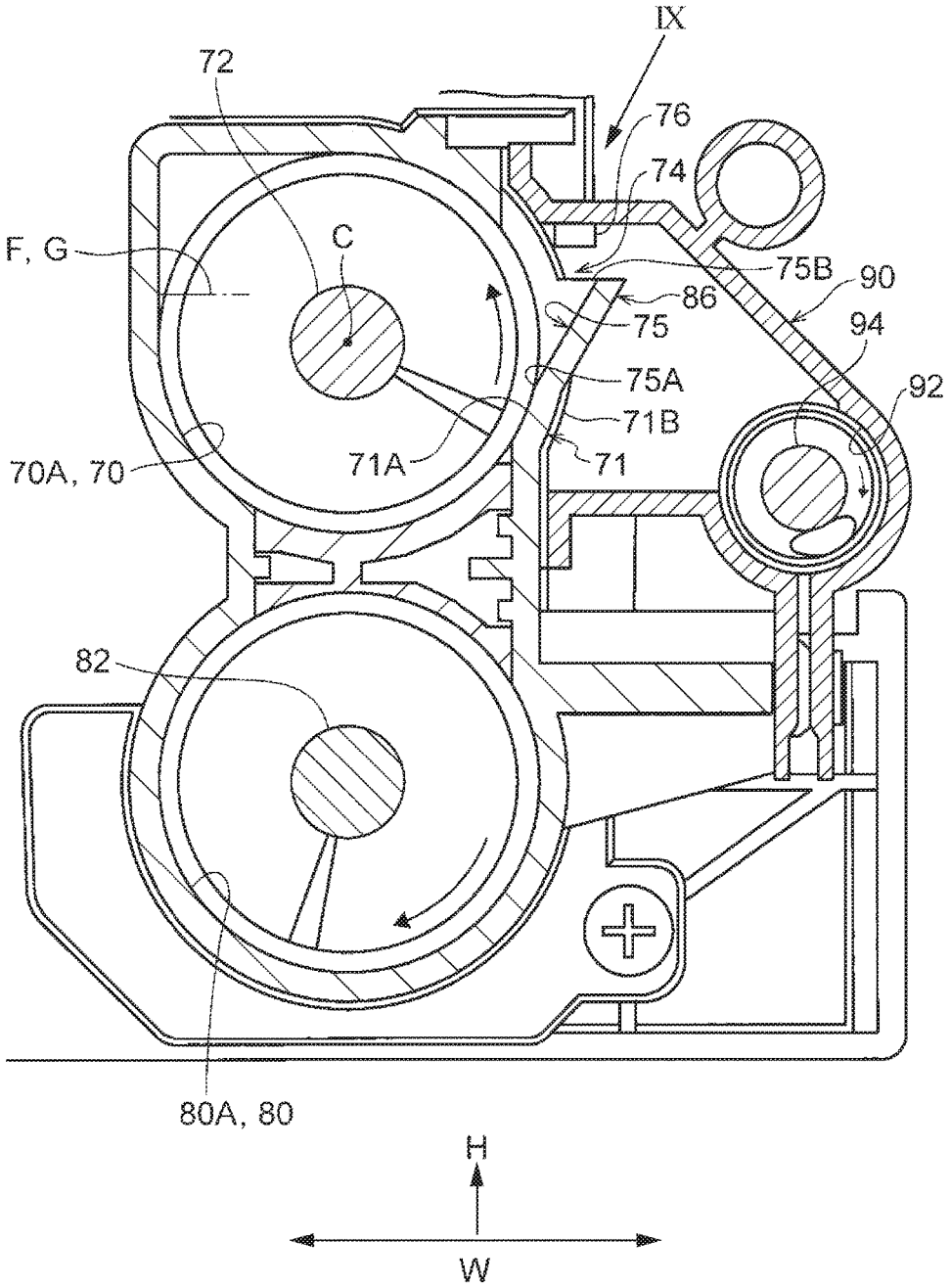
FIG. 5 is an enlarged sectional view of the developing device according to the exemplary embodiment of the present invention.

Referring to FIGS. 4 and 5, the developing device 46 extends in a longitudinal direction, which is the apparatus-depth direction of the image forming apparatus 10 (direction from the proximal side toward the distal side of the plane of FIG. 1). The developing device 46 includes a container 70 that contains a developer G, an auger 72 that is disposed in the container 70, a discharge outlet 74 that has an opening in a side wall 71 of the container 70, and a magnet 76 that is disposed above a lower surface 75 of the discharge outlet 74.

The container 70 extends in a longitudinal direction, which is the apparatus-depth direction. One end portion of the container 70 in the longitudinal direction (end portion that is in a proximal part of the container 70 in the apparatus-depth direction) is a cylindrical portion 70A. A cylindrical supply inlet 78, which protrudes upward in the apparatus-height direction, is disposed on the cylindrical portion 70A. The inside of the supply inlet 78 is connected to the inside of the cylindrical portion 70A. A developer G, which has been suppled from the toner cartridge 28, is supplied to the container 70 and to a container 80 (described below).

The auger 72 is disposed in the container 70 so as to extend in a rotation-axis direction (indicated by an arrow X in FIG. 4), which is the longitudinal direction of the container 70 (the apparatus-depth direction). The auger 72 is rotated by a driving force transmitted from a driving source (not shown) and transports the developer G in the container 70 in the rotation-axis direction X while agitating the developer G. In the present exemplary embodiment, when the auger 72 rotates, the developer G is transported from a distal part toward a proximal part of the container 70 in the apparatus-depth direction. The auger 72 is an example of a transport member in the present invention.

Figure 6:
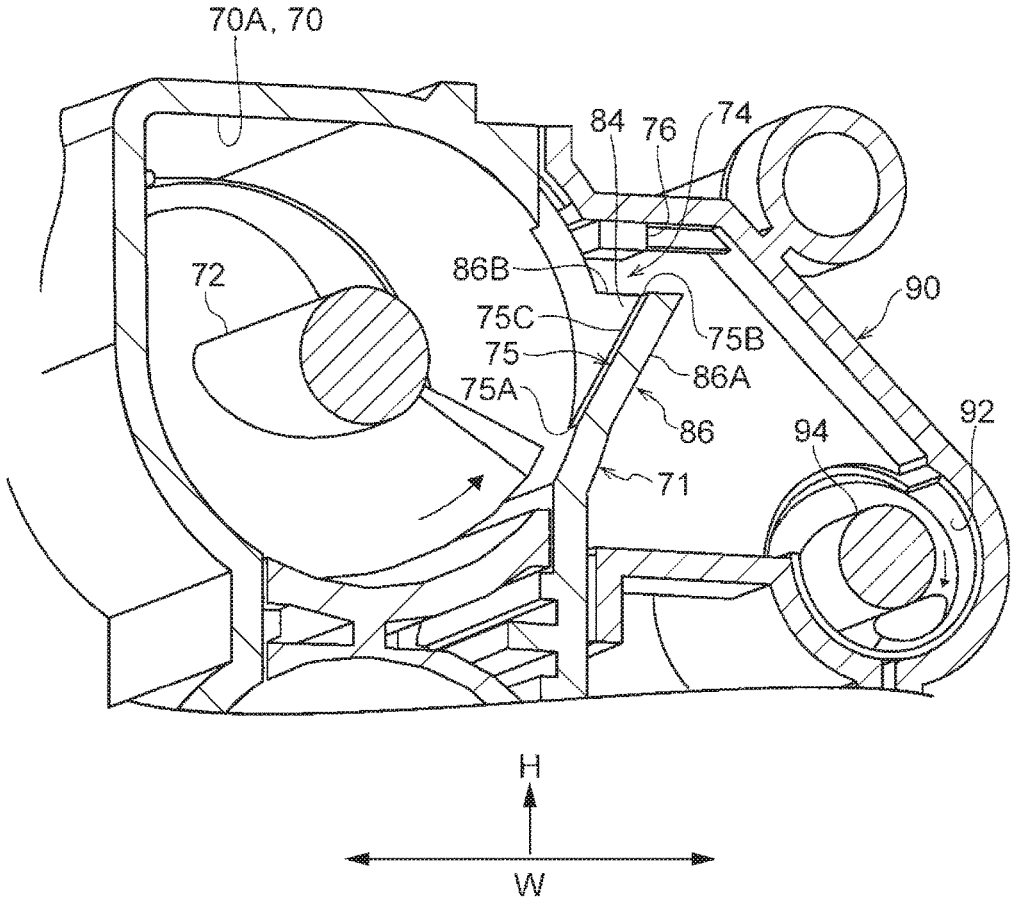
FIG. 6 is a partial enlarged sectional perspective view of the developing device according to the exemplary embodiment of the present invention.

The discharge outlet 74 has an opening in the side wall 71 of the container 70 facing in the apparatus-width direction (direction perpendicular to the rotation-axis direction X). To be specific, the discharge outlet 74 has the opening in the side wall 71 of the cylindrical portion 70A. Referring to FIGS. 5 and 6, as seen in a cross section perpendicular to the rotation-axis direction X, the lower surface 75 of the discharge outlet 74 extends diagonally upward from an inner surface 71A of the side wall 71 and crosses an outer surface 71B of the side wall 71. In other words, the lower surface 75 extends diagonally upward from the inner surface 71A of the side wall 71, crosses the outer surface 71B, and protrudes to the outside of the cylindrical portion 70A (outside of the side wall 71). A lower end 75A of the lower surface 75, which is at the boundary between the lower surface 75 and the inner surface 71A of the side wall 71, is located below an axis C of the auger 72 in the apparatus-up-down direction. An upper end 75B of the lower surface 75 is located above the axis C of the auger 72 in the apparatus-up-down direction.

Figure 7:
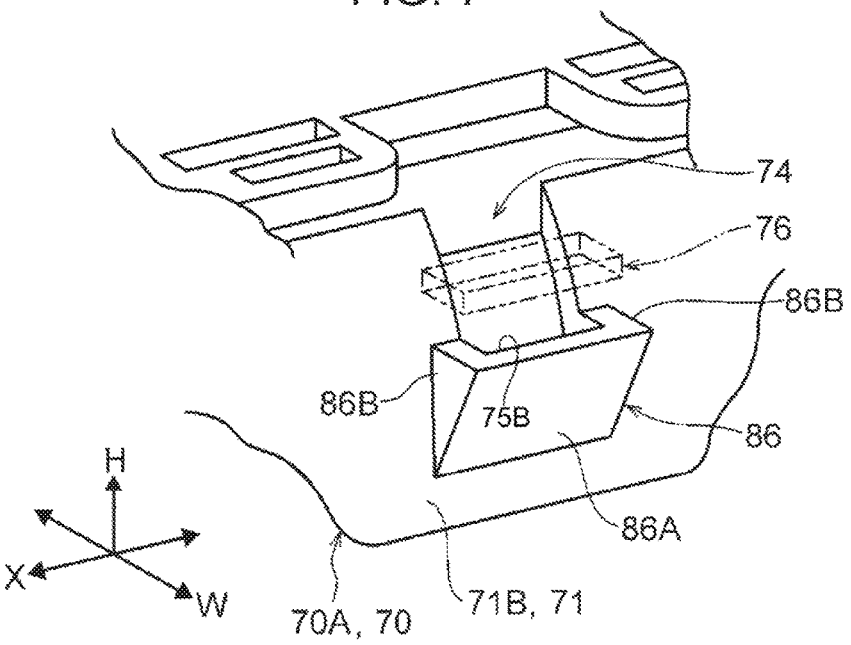
FIG. 7 is an external perspective view illustrating a discharge outlet of the developing device according to the exemplary embodiment of the present invention.

Referring to FIGS. 6 and 7, both side surfaces 84 of the discharge outlet 74 are respectively connected to both ends 75C of the lower surface 75 in the rotation-axis direction X. In the present exemplary embodiment, an inclined wall 86, which has an angular-U-shaped cross section, is formed so as to cover a lower part of the opening formed in the side wall 71. The inclined wall 86 includes an inclined portion 86A, which extends diagonally upward from a lower edge of the opening; and side portions 86B, which protrude from side edges of the opening and connect the inclined portion 86A to the outer surface 71B. Note that a surface of the inclined portion 86A located inside the container 70 is the lower surface 75, and inner surfaces of the side portions 86B are the side surfaces 84.

When the height of the surface F of the developer G in the container 70 (cylindrical portion 70A) becomes greater than the height of the lower surface 75 of the discharge outlet 74, to be specific, the height of the upper end 75B of the lower surface 75, a part of the developer G located above the upper end 75B is discharged to the outside through the discharge outlet 74.

Figure 9:
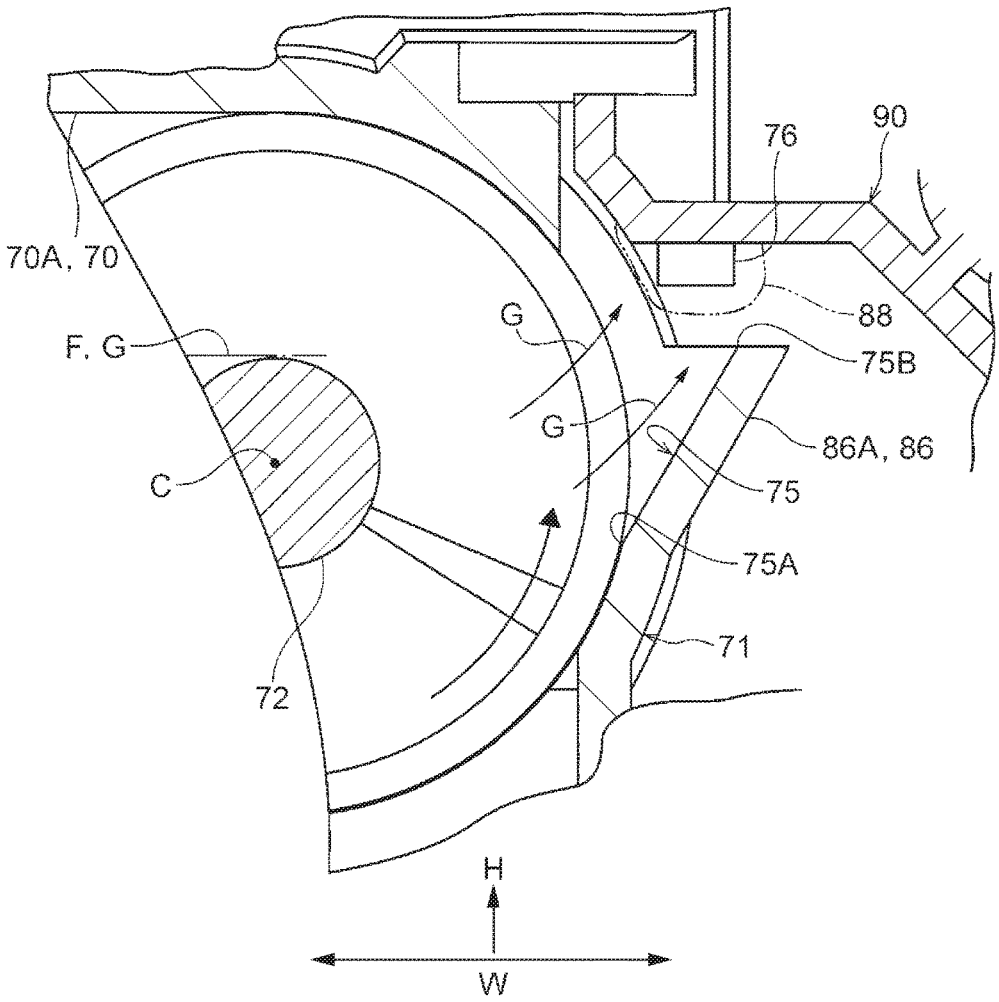
FIG. 9 is an enlarged view illustrating a portion of the developing device indicated by an arrow IX in FIG. 5.

Referring to FIG. 9, the magnet 76 is disposed at a position that is above the lower surface 75 of the discharge outlet 74 and that overlaps the lower surface 75 in the up-down direction. The magnet 76 attracts a part of the developer G that is lifted up (stirred upward) and scattered as the auger 72 rotates. Thus, a part of the developer G is attracted by the magnet 76 and forms a developer accumulated portion 88 around the magnet 76.

Figure 8:
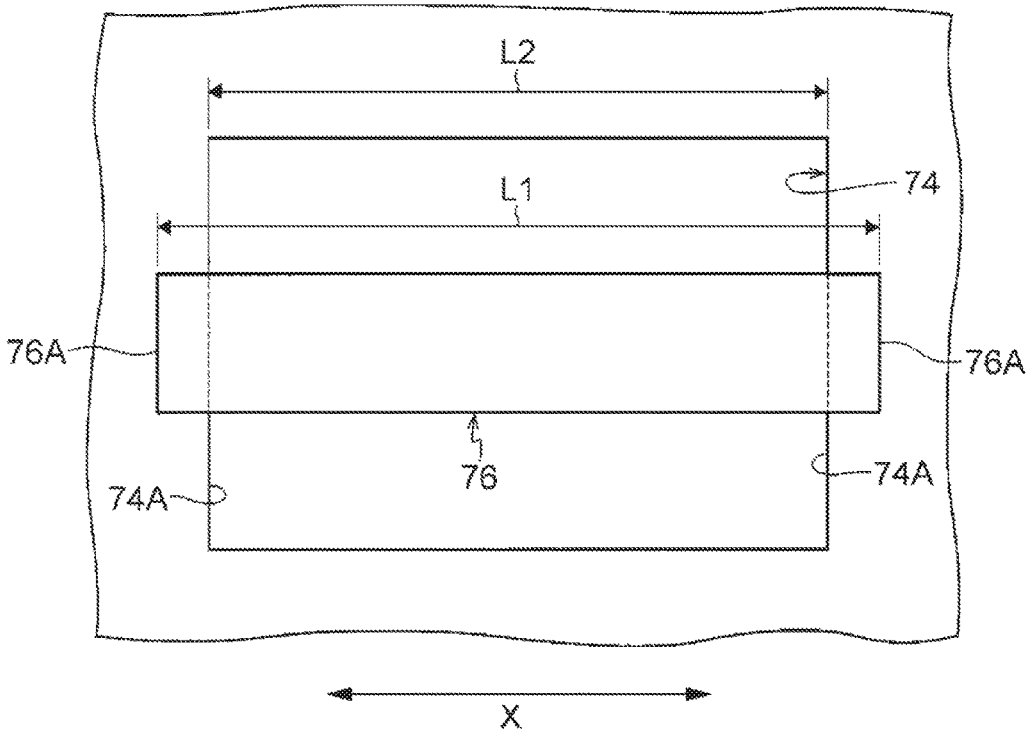
FIG. 8 is a plan view illustrating the discharge outlet and a magnetic member of the developing device according to the exemplary embodiment of the present invention.

Referring to FIGS. 7 and 8, the length L1 of the magnet 76 in the rotation-axis direction X is greater than the length L2 of the discharge outlet 74 in the rotation-axis direction X. Therefore, when the discharge outlet 74 is seen in the plan view of FIG. 8, both end portions 76A of the magnet 76 in the longitudinal direction (the rotation-axis direction X) overlap side edges 74A of the discharge outlet 74. In other words, in the plan view, both end portions 76A of the magnet 76 extend beyond both side edges of the discharge outlet 74. The magnet 76 is an example of a magnetic member in the present invention.

Referring to FIG. 5, the container 80, which extends in a longitudinal direction that is the apparatus-depth direction, is disposed below the container 70. The container 70 and the container 80 are connected to each other through a passage (not shown) that is located between the supply inlet 78 and the discharge outlet 74 in the apparatus-depth direction.

One end portion of the container 80 in the longitudinal direction (end portion that is in a proximal part of the container 80 in the apparatus-depth direction) is a cylindrical portion 80A. An auger 82 is rotatably disposed in the container 80 so as to extend in a rotation-axis direction, which is the longitudinal direction of the container 80 (the apparatus-depth direction). The auger 82 is rotated by a driving force transmitted from a driving source (not shown) and transports the developer G in the container 80 in the rotation-axis direction X while agitating the developer G. In the present exemplary embodiment, when the auger 82 rotates, the developer G, which has flowed into the container 80 from the container 70 through the passage, is transported from a proximal part toward a distal part of the container 80 in the apparatus-depth direction.

The container 70 and the container 80 are connected to each other also through another passage (not shown) in distal end portions thereof in the apparatus-depth direction. The developer G is transported in the container 80 by the auger 82 and moves to the container 70 through the other passage. The developer G is transported by the auger 72 in the container 70 toward a proximal part of the container 70 in the apparatus-depth direction. That is, the inside of the container 70 and the inside of the container 80, which are connected to each other through the passage and the other passage, form a circulation path of the developer G. The developer G in the container 70 is transported to a developing roller 47 and used to develop an electrostatic latent image on the image carrier 40.

A proximal end portion of the auger 72 in the apparatus-depth direction has a blade (not shown) that is helically wound in the opposite direction. New developer G that is supplied from the supply inlet 78 is mixed with old developer G (developer whose toner has been consumed), which has been transported from a distal part toward a proximal part of the container 70, and moves to the container 80 (cylindrical portion 80A) through the passage.

Referring to FIG. 5, the developing device 46 includes a cover 90 that is attached to the side wall 71 of the cylindrical portion 70A so as to cover the discharge outlet 74. The inside of the cover 90 is connected to the inside of the cylindrical portion 70A through the discharge outlet 74. The cover 90 is capable of temporarily storing the developer G that has been discharged from the discharge outlet 74. In the present exemplary embodiment, the magnet 76 is attached, by using an adhesive tape, to a portion of an upper surface of the cover 90 that covers the discharge outlet 74 from above.

A recovery pipe 92 (see FIG. 4) is connected to a lower part of the cover 90. The recovery pipe 92 is used to transport the developer G that is temporarily stored in the cover 90 to a recovery portion (not shown). An auger 94 is disposed in the recovery pipe 92 so as to extend in a rotation-axis direction, which is the axial direction of the recovery pipe 92. As the auger 94 rotates, the developer G stored in the cover 90 is transported from a proximal part toward a distal part of the cover 90 in the apparatus-depth direction and recovered in the recovery portion (not shown).

Next, the function of the present exemplary embodiment will be described.

In the developing device 46, new developer G is supplied to the container 70 (cylindrical portion 70A) through the supply inlet 78. As the new developer G is supplied, the amount of developer G in the container 70 and the container 80 (hereinafter, referred to as "developer amount", as appropriate) increases. When the height of the surface F of the developer G in the container 70 becomes greater than the height of the discharge outlet 74, which is formed in the side wall 71 of the container 70, surplus developer G is discharged from the inside of the container 70 to the inside of the cover 90 through the discharge outlet 74. To be specific, the developer G overflows along the lower surface 75 of the discharge outlet 74 and is discharged to the inside of the cover 90 beyond the upper end 75B. The developer G that has been discharged to the inside of the cover 90 is temporarily stored in the cover 90. Subsequently, as the auger 94 rotates, the developer G is transported to the recovery portion (not shown) through the recovery pipe 92.

In the developing device 46, a part of the developer G that has been lifted up and scattered as the auger 72 rotates is attracted by the magnetic force of the magnet 76, which is located above the lower surface 75 of the discharge outlet 74. Since the magnet 76 attracts the developer G, even when the developer G is lifted up (stirred upward) and scattered in the container 70 (cylindrical portion 70A), movement of the developer G to the inside of the cover 90, which is located in a downstream part of a discharge path of the developer G, through the discharge outlet 74 is suppressed.

The developer G attracted by the magnet 76 forms the developer accumulated portion 88 around the magnet 76. Since the developer accumulated portion 88 is formed around the magnet 76, it is possible to attract the developer G that has been scattered over a larger region. The magnet 76 is disposed at a position that is above the lower surface 75 of the discharge outlet 74 and that overlaps the lower surface 75 in the up-down direction. Therefore, even when a part of the developer accumulated portion 88 comes off, it is possible to suppress falling of the part of the developer G into the cover 90.

That is, in the developing device 46, the magnet 76 is disposed at a position that is above the lower surface 75 of the discharge outlet 74 and that overlaps the lower surface 75 in the up-down direction. Therefore, for example, compared with a structure in which the magnet 76 is disposed downstream of the discharge outlet 74 along the discharge path of the developer G, when the developer G is lifted up and scattered in the container 70, movement of the developer G into the cover 90, which is located downstream along the discharge path, through the discharge outlet 74 is suppressed.

In particular, in the case where the developer G for white (W) or silver (S), whose particle size differs from that of the developer G for a reference color, is used, the amount (height) of the developer G that is lifted up by the auger 72 changes. However, by using the developing device 46 according to the present exemplary embodiment, even in the case where a having different a particle size is used, when the developer G is lifted up and scattered, movement of the developer G into the cover 90, which is located downstream of the discharge path, through the discharge outlet 74 is suppressed.

Likewise, when the rotation speed of the auger 72 is changed, in particular, the auger 72 is rotated at a higher speed, the amount (height) of the developer G lifted up by the auger 72 changes. However, by using the developing device 46 according to the present exemplary embodiment, even when the auger 72 rotates at a higher speed and the developer G is lifted up and scattered, movement of the developer G to the inside of the cover 90, which is located downstream of the discharge path, through the discharge outlet 74 is suppressed.

In the developing device 46, as seen in a cross section perpendicular to the rotation-axis direction X of the auger 72, the lower surface 75 of the discharge outlet 74 extends diagonally upward and crosses the outer surface 71B of the side wall 71. Therefore, for example, compared with a structure in which the lower surface 75 of the discharge outlet 74 extends in the thickness direction of the side wall 71, it is possible to return a larger amount of developer G attracted by the magnet 76 to the container 70. To be specific, even when a part of the developer G that forms the developer accumulated portion 88 comes off, the developer G is returned to the container 70 (cylindrical portion 70A) along the lower surface 75.

In the developing device 46, when the discharge outlet 74 is seen in plan view, both end portions 76A of the magnet 76 in the rotation-axis direction overlap the edges of the discharge outlet 74. Therefore, for example, compared with a structure in which both end portions 76A of the magnet 76 in the rotation-axis direction X are located inside of the edges of the discharge outlet 74, the developer accumulated portion 88 is uniformly formed in the longitudinal direction of the magnet 76. As a result, it is possible to reduce the amount of the developer G that passes through spaces below the end portions 76A of the magnet 76.

Compared with a structure that does not include the developing device 46, the image forming apparatus 10 is capable of holding a larger amount of developer in the container 70.

Compared with a structure that includes developing devices that have different specifications in accordance with the particle sizes of developers, in the image forming apparatus 10, it is possible to use the same developing devices 46 for developers G having different particle sizes, and therefore the cost of the image forming apparatus 10 is reduced.

In the exemplary embodiment described above, the magnet 76 is used as an example of a magnetic member in the present invention. However, this is not a limitation on the present invention. For example, a metal member may be used as a magnetic member, and the metal member may be magnetized (for example, magnetized by using an electromagnetic force).

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a container that contains a developer including a carrier and a toner;

a transport member that is rotatably disposed in the container and configured to agitate and transport the developer in a rotation-axis direction thereof;

a discharge outlet that has an opening in a side wall of the container facing in a direction perpendicular to the rotation-axis direction, the discharge outlet configured, in a case where a height of a surface of the developer becomes greater than a height of a lower surface of the discharge outlet, to allow the developer to be discharged to an outside of the container; and a magnetic member that is disposed at a position that is above the lower surface of the discharge outlet and that overlaps the lower surface, in an up-down direction and at a side of the lower surface facing the transport member, the magnetic member configured to attract a part of the developer that is lifted up by the transport member.

2. The developing device according to claim 1, wherein the lower surface of the discharge outlet extends diagonally upward and crosses an outer surface of the side wall as seen in a cross section perpendicular to the rotation-axis direction, and wherein both side surfaces of the discharge outlet are respectively connected to both ends of the lower surface in the rotation-axis direction.

3. The developing device according to claim 2, wherein a length of the magnetic member in the rotation-axis direction is greater than a length of the discharge outlet in the rotation-axis direction, and both end portions of the magnetic member in the rotation-axis direction overlap edge portions of the discharge outlet in a case where the discharge outlet is seen in plan view.

4. The developing device according to claim 1, wherein a length of the magnetic member in the rotation-axis direction is greater than a length of the discharge outlet in the rotation-axis direction, and both end portions of the magnetic member in the rotation-axis direction overlap edge portions of the discharge outlet in a case where the discharge outlet is seen in plan view.

5. An image forming apparatus comprising:

an image carrier on which an electrostatic latent image is configured to be formed;

the developing device according to claim 1, wherein the developing device is configured to develop the electrostatic latent image formed on the image carrier; and a fixing unit configured to fix an image developed by the developing device to a recording medium.

6. The image forming apparatus according to claim 5, comprising:

a plurality of the developing devices, wherein one of the plurality of developing devices is configured to use a developer whose particle size is different from a particle size of any of developers used by the other developing devices.

7. The developing device according to claim 1, wherein the magnetic member is arranged over the lower surface such that excess developer, accumulated on the magnetic member, will fall from the magnetic member and back to the transport member rather than being discharged to the outside of the container.

8. The developing device according to claim 1, wherein in a direction perpendicular to the up-down direction, the magnetic member is longer than the discharge outlet.

9. The developing device according to claim 1, wherein in the up-down direction, the magnetic member faces the inclined surface.

10. A developing device comprising:

a container that contains a developer including a carrier and a toner;

a transport member that is rotatably disposed in the container and configured to agitate and transport the developer in a rotation-axis direction thereof;

a discharge outlet that has an opening in a side wall of the container facing in a direction perpendicular to the rotation-axis direction, the discharge outlet configured, in a case where a height of a surface of the developer becomes greater than a height of a lower surface of the discharge outlet, to allow the developer to be discharged to an outside of the container; and a magnetic member that is disposed at a position that is above the lower surface of the discharge outlet and that overlaps the lower surface, in an up-down direction, the magnetic member configured to attract a part of the developer that is lifted up by the transport member, wherein a length of the magnetic member in the rotation-axis direction is greater than a length of the discharge outlet in the rotation-axis direction, and both end portions of the magnetic member in the rotation-axis direction overlap edge portions of the discharge outlet in a case where the discharge outlet is seen in plan view.

* * * * *